United States Patent [19]

Leinonen et al.

[11] 4,114,085

[45] Sep. 12, 1978

[54] METHOD OF IMPROVING THE TEMPERATURE STABILITY OF A VOLTAGE SOURCE, AND A STABILIZED VOLTAGE SOURCE FOR CARRYING OUT THE METHOD

[75] Inventors: Erkki Ilmari Leinonen, Vantaa; Erkki Sakari Kiuru, Espoo, both of Finland

[73] Assignee: Outokumpu Oy, Ab., Helsinki, Finland

[21] Appl. No.: 735,983

[22] Filed: Oct. 27, 1976

[30] Foreign Application Priority Data

Oct. 27, 1975 [FI] Finland ..... 752995

[51] Int. Cl.[2] ..... G05F 1/58

[52] U.S. Cl. ..... 323/17; 323/22 T; 323/68

[58] Field of Search ..... 323/1, 4, 9, 16, 17, 323/19, 22 T, 68, 69

[56] References Cited

U.S. PATENT DOCUMENTS

| | | | |
|---|---|---|---|
| 3,443,202 | 5/1969 | Moulton | 323/22 T |
| 3,828,240 | 8/1974 | Keller et al. | 323/22 T |
| 3,887,863 | 6/1975 | Brokaw | 323/19 |
| 4,002,964 | 1/1977 | Gordon | 323/68 |

*Primary Examiner*—Gerald Goldberg

*Attorney, Agent, or Firm*—Brooks, Haidt, Haffner & Delahunty

[57] ABSTRACT

In a stabilized voltage source having an actual-value voltage gauge which is temperature dependent, the overall temperature stability of the voltage source is improved by providing a reference-value voltage with an adjustable temperature coefficient, said temperature coefficient being so adjusted that it substantially compensates for the temperature dependence of the actual-value voltage gauge within the temperature range used. The reference voltage having an adjustable temperature coefficient is preferably obtained by combining a first voltage which is essentially independent of temperature with a second voltage being strongly dependent on temperature, the degree of mutual influence of said combined voltages being regulated to adjust said temperature coefficient.

3 Claims, 2 Drawing Figures

METHOD OF IMPROVING THE TEMPERATURE STABILITY OF A VOLTAGE SOURCE, AND A STABILIZED VOLTAGE SOURCE FOR CARRYING OUT THE METHOD

BACKGROUND OF THE INVENTION

1. Field of the Invention

The present invention relates to a stabilized voltage source, the control circuit of which includes a temperature-dependent gauge for the actual-value voltage. The invention also relates to a method for improving the temperature stability of such voltage source.

2. Description of the Prior Art

Resistive voltage dividers are generally used as actualvalue gauges in voltage sources. Especially in high-voltage applications the high-voltage side resistor of a voltage source will have a resistance of hundreds of megaohms, if it is desired to use a small-sized gauge which dissipates little power. The best high-ohm, high-voltage resistors available have temperature coefficients of the order of ± 100 ppm/K.

It also follows from the above that the temperature coefficients of known voltage sources provided with high-voltage resistors of the said type are of the same order as those of the high-voltage resistors in question, i.e., the voltage sources are not so temperature-stable as would be desirable.

SUMMARY OF THE INVENTION

The present invention provides a stabilized voltage source, which comprises means for regulating the temperature coefficient of the output voltage the reference-value circuit within the range of the temperature coefficient of the actual-value voltage gauge.

Correspondingly, the method according to the invention comprises forming for the voltage source a reference-value voltage with an adjustable temperature coefficient and adjusting said temperature coefficient so that the temperature coefficient of the actual-value gauge is substantially annulled within the temperature range used.

The object of the present invention is to eliminate the problem of temperature dependence involved in known circuits and to provide a voltage source, especially for high voltages, having a considerably improved temperature stability.

If good electronic components and large control-circuit loop amplification are used, the temperature stability of a voltage source can be considered to be determined only on the basis of the stabilities of the actual-value gauge and the reference-value voltage source.

As was noted above, high-ohm resistors with great stability are not available. Since, however, the temperature coefficient of such resistors is constant, the present invention is based on compensation of the said temperature coefficient by means of a reference-value voltage dependent on the temperature in a corresponding manner; thereby a voltage source is obtained in which the temperature coefficient of the output voltage is considerably better, i.e., smaller than that of the gauge used.

DESCRIPTION OF THE PREFERRED EMBODIMENTS

Figure 1:
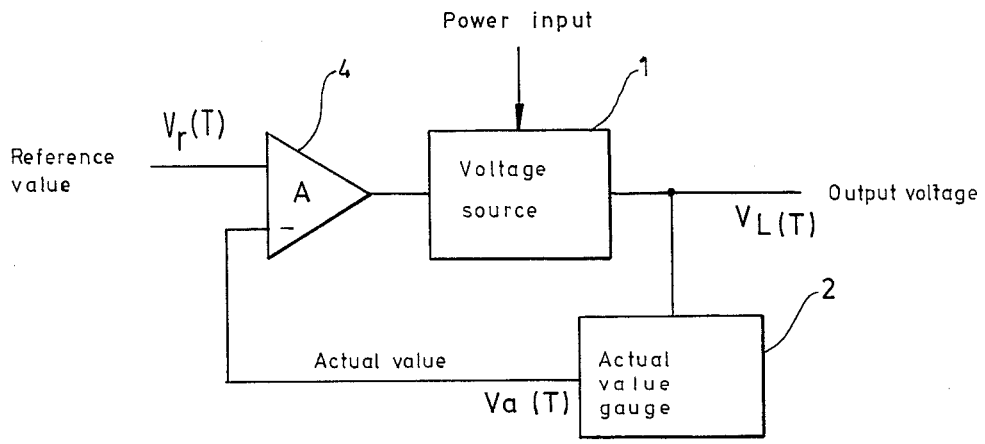
FIG. 1 depicts a typical block diagram of the voltage source.

If it is assumed that the direct-voltage amplification A of the differential amplifier 4 (FIG. 1) is very large, it can be thought that where $V_a$ is the actual value voltage and $V_r$ is the reference voltage.

$$V_r - V_a = 0 \tag{1}$$

The following dependence prevails between the initial voltage $V_L$ and the actual value $V_a$:

$$V_L = K_a \cdot V_a \tag{2}$$

Since $V_a = V_r$ $$V_L = K_a \cdot V_r \tag{3}$$

The gauge constant $K_a$ and the actual-value voltage are functions of the temperature T so in the following description and drawings these and other quantities dependent upon the temperature T are indicated by the notation (T) following the temperature dependent quantity as, for example $K_a(T)$, $V_r(T)$, etc., to show that these quantities are functions of the temperature T.

It is assumed that $K_a$ and $V_r$ are both linear functions of the temperature.

$$K_a(T) = P_a \cdot (1 + C_a T) \tag{4}$$

$$V_r(T) = P_r \cdot V_z \cdot (1 + C_r T) \tag{5}$$

$P_a$, $P_r$, $V_z$ are constant coefficients.

$C_a$, $C_r$ are the temperature coefficients of the actual-value gauge 2 and the reference-value voltage respectively.

$T$ is normalized temperature.

The conditions on which the differential of the initial voltage in regard to the temperature T is zero are observed below:

$$V_L = K_a(T) \cdot V_r(T) \tag{6}$$

$$dV_L = \frac{\delta V_L}{\delta T} dT = \frac{K_a(T)}{T} V_r(T)\, dT + K_a(T) \frac{\delta V_r(T)}{\delta T} dT =$$

$$P_a \cdot P_r \cdot V_z \cdot \; [C_a \cdot (1 + C_r T) + C_r \cdot (1 + C_a T)] \cdot dT$$

When temperature $T = O$ $$dV_L(0) = P_a \cdot P_r \cdot V_z \cdot (C_a + C_r) \cdot dT$$

If it is now desired that $dV_L(0) = 0$, $$C_a + C_r = 0 \text{ i.e. } C_a = -C_r$$

is obtained (note: $dT \neq 0$).

The obtained result is placed in the expression (6) for $dV_L$, and $$dV_L(T) = -2 \cdot P_a \cdot P_r \cdot V_z \cdot C_a^2 \cdot T \cdot dT \tag{7}$$

is obtained.

Within a wider temperature range $$\Delta V_L(T) = \int_{T=D}^{\Delta T} 2 \cdot P_a \cdot P_r \cdot V_z \cdot C_a^2 \cdot T \cdot dT = \tag{8}$$

-continued $$-P_a \cdot P_r \cdot V_z \cdot C_a^2 \cdot (\Delta T)^2$$

is valid.

Since $V_L$ is at temperature $T = 0$.

$$V_L(0) = P_a \cdot P_r \cdot V_z$$

ps the temperature coefficient obtained for the initial voltage is $$\frac{\Delta V_L}{V_L(O)\Delta T} = -C_a^2 \cdot \Delta T \quad (9)$$

In an uncompensated case (when $C_r = 0$)

$$\frac{\Delta V_L}{V_L(O)\Delta T} = C_a \quad (10)$$

is obtained.

EXAMPLE

It is assumed that the temperature coefficient of the actual-value gauge $C_a = 100$ ppm/K and the extend of its operation temperature range ($\Delta T$) is 50 K.

In an uncompensated case $$\frac{\Delta V_L}{V_L(O)\Delta T} = 100 \text{ ppm}/K$$

is obtained according to Equation (10).

In a compensated case $$\frac{\Delta V_L}{V_L(O)\Delta T} = -(100\ 10^{-6}/K)^2 \cdot 50K = 0.5 \text{ ppm}/K$$

is obtained according to Equation (9).

It is observed that considerable improvement is achieved by the compensation.

If the voltage source can be regulated, the regulation must be performed in such a manner that in the expression for the reference-value voltage $$V_r = P_r \cdot V_z \cdot (1 + C_r T)\ (V_z = \text{constant})$$

the control affects the multiplier coefficient $P_r$; otherwise, different temperature coefficients are obtained with different initial voltages.

Figure 2:
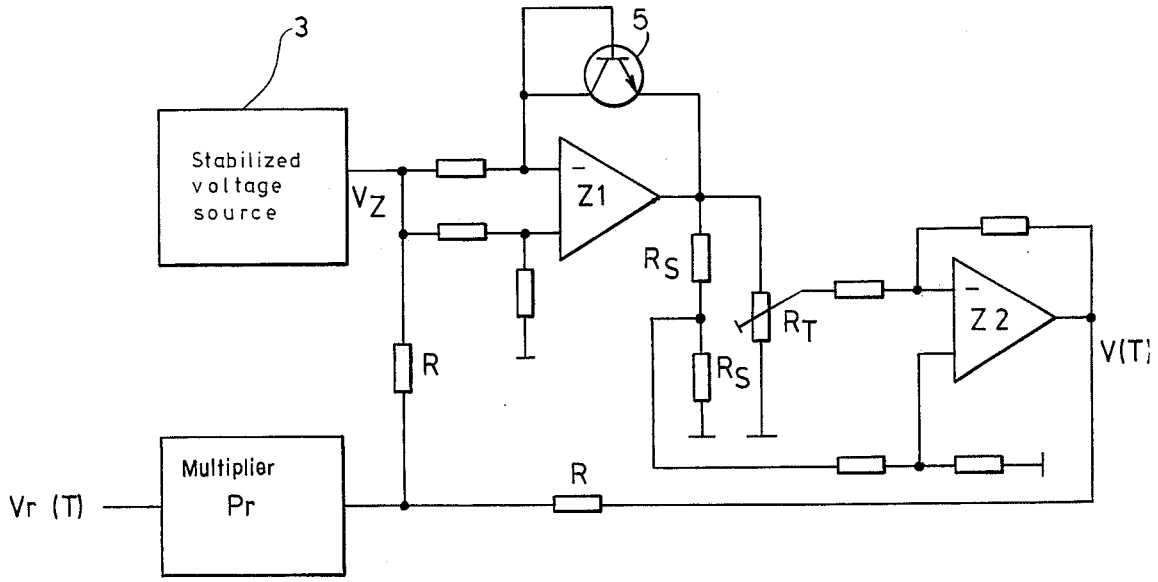
FIG. 2 depicts, partly diagrammatically, the circuit which forms the reference-value voltage of the voltage source.

It has been shown above that, if the temperature coefficient of the reference-value voltage source used can be regulated so that $C_r = -C_a$ ($C_a$ can be measured), a considerable improvement is achieved in the stability of the voltage source. FIG. 2 shows one circuit arrangement which has the above characteristic.

In the wiring, the temperature dependence of the base emitter voltage $V_{BE}$ of the transistor 5 is utilized; within the operation temperature range this dependence can be considered very linear. The transistor 5 forms a reconnection for the differential amplifier Z1, in which case the base and the collector of the transistor have been linked together at the input of the amplifier in the manner indicated in the figure. The output of the amplifier Z1 is passed through the voltage divider $R_s$, $R_s$ into one input of the amplifier Z2 and through the control resistor $R_T$ into the other input; the output voltage V(T) of the amplifier Z2 can be regulated by regulating the resistor $R_T$.

The stable voltage $V_z$ and the temperature-dependent voltage V(T) are summed by means of the resistors R. The sum voltage is multiplied by the coefficient $P_r$; by changing $P_r$ in the multiplier shown in FIG. 2 the initial voltage $V_r(T)$ can be regulated without changing the temperature coefficient. By means of the trimmer $R_T$ serving as the bridge resistor the temperature coefficient of the voltage $V_r(T)$ is adjusted to the desired value.

What is claimed is:

1. In a stabilized voltage source of the type having a temperature-dependent actual voltage gauge which senses the output voltage of the voltage source, a reference value circuit providing a reference value voltage, said reference value circuit comprising a temperature-stable first voltage source and a second voltage source which is strongly dependent on temperature, means for summing the voltage outputs of said first and second voltage source of said reference value circuit, and means for regulating the output voltage of at least one of said first and second voltage sources to control the reference value voltage for regulating the temperature coefficient of the reference value voltage to compensate for temperature dependence of the actual value voltage.

2. A stabilized voltage source according to claim 1, wherein said second voltage source which is strongly dependent on temperature comprises a differential amplifier, a transistor in a feed-back circuit of said differential amplifier, a collector of said transistor being connected to the input side of said amplifier and an emitter of said transistor being connected to the output side of said amplifier.

3. A method of improving the temperature stability of a voltage source having a temperature-dependent actual-value voltage gauge, which comprises: providing a reference-value voltage for said voltage source by means of a reference-value voltage circuit having an adjustable temperature coefficient; and adjusting said adjustable temperature coefficient to produce a reference-value voltage which compensates for the temperature dependence of said actual-value voltage gauge, said reference value voltage being produced by summing the voltage outputs of a first voltage source independent of temperature and a second voltage source strongly dependent on temperature, and including regulating the output voltage of at least one of said first and second voltage sources before said summing to adjust the reference-value voltage.

* * * * *

UNITED STATES PATENT AND TRADEMARK OFFICE

CERTIFICATE OF CORRECTION

PATENT NO. : 4,114,085

DATED : September 12, 1978

INVENTOR(S) : Erkki Ilmari Leinonen; Erkki Sakari Kiuru

It is certified that error appears in the above-identified patent and that said Letters Patent are hereby corrected as shown below:

Col. 2, line 66, Equation 8 "∫" omitted; "-" omitted
line 67, Equation 8 "T=D" should read --T=O--

Equation should read:

$$--\Delta V_L(T) = \int_{T=O}^{\Delta T} - 2 \cdot P_a \cdot P_r \cdot V_z \cdot C_a^2 \cdot T \cdot dT = --$$

Signed and Sealed this

Thirtieth Day of January 1979

[SEAL]

Attest:

RUTH C. MASON
Attesting Officer

DONALD W. BANNER
Commissioner of Patents and Trademarks